United States Patent [19]

Schleupen

[11] Patent Number: 4,886,037

[45] Date of Patent: Dec. 12, 1989

[54] IGNITION SYSTEM FOR AN INTERNAL COMBUSTION ENGINE

[75] Inventor: Richard Schleupen, Ingersheim, Fed. Rep. of Germany

[73] Assignee: Robert GmbH Bosch, Stuttgart, Fed. Rep. of Germany

[21] Appl. No.: 26,864

[22] Filed: Mar. 17, 1987

[30] Foreign Application Priority Data

May 9, 1986 [DE] Fed. Rep. of Germany ..... 3615548

[51] Int. Cl.[4] ..... F03P 3/04

[52] U.S. Cl. ..... 123/645; 123/644

[58] Field of Search ..... 123/644, 645

[56] References Cited

U.S. PATENT DOCUMENTS

| | | | |
|---|---|---|---|
| 432,493 | 4/1982 | Merrick | 123/606 |
| 2,487,186 | 6/1961 | Burgoon et al. | 210/220 |
| 3,145,727 | 7/1965 | Kibbee | 210/195.4 |
| 3,206,032 | 9/1965 | Nottingham et al. | 210/221.1 X |
| 3,805,957 | 4/1974 | Oldham et al. | 210/220 X |
| 3,931,817 | 4/1976 | Snyder | 210/521 |
| 4,077,379 | 3/1978 | Jundt | 123/645 |
| 4,290,406 | 9/1981 | Iyoda | 123/645 |
| 4,382,431 | 5/1983 | Bodil | 123/644 |
| 4,653,460 | 3/1987 | Ooyabu | 123/645 |

FOREIGN PATENT DOCUMENTS

| | | | |
|---|---|---|---|
| 2406018 | 8/1974 | Fed. Rep. of Germany | 123/645 |

*Primary Examiner*—Ronald B. Cox

*Attorney, Agent, or Firm*—Frishauf, Holtz, Goodman & Woodward

[57] ABSTRACT

To prevent spurious sparks from arising at a spark plug (6) connected to the secondary (3) of an ignition coil upon sudden current rise through the primary (2) when a switching transistor (4) serially connected with the primary becomes conductive, the primary (2) of the ignition coil is serially connected with another resistor (7) to form one branch of a bridge circuit, the other branch being formed by two resistors (8, 9) connected in parallel with said first branch.

The diagonal terminals (11, 11') are connected to a source of reference voltage (Uref), formed for example by a Zener diode (12) and the emitter-base path of a control transistor (13), the collector of which is connected to the base of a driver transistor (14) which is controlled from an ignition control source (i) either to conduction or non-conduction to, in turn and 180° out of phase, control non-conduction and conduction of the switching transistor (4). Current from the collectro of the control transistor to the base of the driver transistor (14) modifies the current to the base of the switching transistor (4) by branching current flow to the base under control of the driver transistor. Preferably, the resistor (7) in series with the primary (2) of the ignition coil is either of a value somewhat in excess of the ohmic resistance of the primary (2) of the ignition coil or the resistance value can be controlled as a function of an operating parameter of the engine of which the ignition system forms a part, for example decreasing in value as the pressure of compression within the cylinder, of which the spark plug is a part, increases.

5 Claims, 1 Drawing Sheet

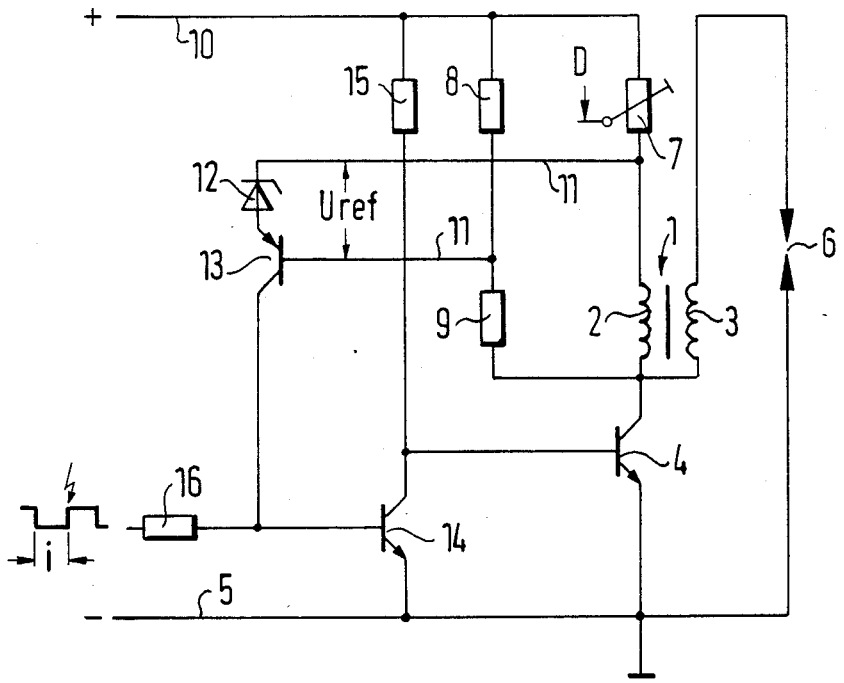
+
10
15
8
D
7
12
Uref
11
11
13
1
6
9
2
3
4
16
14
i
5
-

IGNITION SYSTEM FOR AN INTERNAL COMBUSTION ENGINE

The present invention relates to an ignition system for an internal combustion engine, and more particularly to an ignition system utilizing an ignition coil, and in which the current through the coil to store energy in the coil is controlled by a transistor serially connected with the coil.

BACKGROUND

Ignition systems in which an ignition coil charges electromagnetic energy upon current flow therethrough, which is released to a spark plug upon interruption of current flow, are well known. One or more spark plugs may be connected to such an ignition coil. Such systems are used frequently with single spark plug systems or with multiple spark plug systems which do not have an interposed distributor. When charge current flow through the ignition coil, upon sudden connection of the coil to an energy source, for example upon conduction of a serially connected transistor, rapid current flow through the primary of the ignition coil may cause an induced pulse in the secondary which may result in flash-over or a spark on a spark plug. This is particularly dangerous in ignition systems using a single spark plug, or in distributorless ignition systems. The voltage induced in the secondary, upon connection of current, when high enough to cause a spark, may occur at an instant of time in which, if explosive mixture is already present in the cylinder of the internal combustion engine, may cause damage to the internal combustion engine and, in any event, result in an undesired misfire.

THE INVENTION

It is an object to improve an ignition system of the type in which a control transistor controls current flow through the primary of an ignition coil in which undesired sparking of a spark plug connected to the secondary is effectively eliminated.

Briefly, a coil charging current control circuit is used to provide for rapid current rise through the ignition coil under controlled conditions, to inhibit excessive rate of current rise through the primary so that a spark voltage might be induced in the secondary. The charging current control circuit includes a bridge circuit, of which the primary winding of the coil forms one branch. A reference voltage source, for example including a Zener diode, is connected in the diagonal of the bridge circuit and, further, is coupled to a control switching element, typically a control transistor, which in turn controls the conduction of the switching transistor which is serially connected with the primary of the spark plug. Thus, an optimal charge time rate or charging time of current flow to the ignition coil can be commanded.

The system has the advantage that, with few and simple circuit elements, it is possible to effectively inhibit the generation of sparks at the spark plug at undesired time instants.

DRAWING

The single FIGURE is a schematic circuit diagram of the system in accordance with the present invention.

DETAILED DESCRIPTION

The circuit as illustrated may be used for an internal combustion engine (ICE) intended, for example, for installation in an automotive vehicle. The circuit includes an ignition coil 1 having a primary winding 2 and a secondary winding 3. The primary is serially connected to a switching transistor 4, by being connected to the collector thereof; the emitter of transistor 4 is connected to the negative terminal of a current source, for example the vehicle battery, and shown generally as a bus 5. The bus 5 is, as shown, also connected to ground or vehicle chassis. The secondary winding 4 has the terminal thereof which is connected to the collector of the transistor 4 and to one terminal of the secondary winding 3; the free terminal of the secondary winding 3 is connected to a spark plug 6, as well known and in accordance with standard ignition system connection. The second terminal of the spark plug 6 is connected to ground or chassis 5.

In accordance with a feature of the invention, the primary winding 2 is connected in a bridge circuit formed by resistors 7, 8, 9, and having diagonal terminals 11, 11'. The terminal of primary 2, remote from the transistor 4, thus is connected to the bridge diagonal 11 and to a bridge resistor 7 which, in turn, is connected to the positive terminal of the current supply, formed by a bus 10. Bridge resistors 8, 9, having a diagonal junction 11', form a series circuit which, in turn, is connected between bus 10 and the common junction of primary coil 2, collector of transistor 4 and one terminal of the secondary 3.

The diagonal connection 11 is connected between resistor 7 and primary 2; the diagonal 11' is connected between the two series resistors 8, 9. The diagonal 11, 11' has a reference voltage Uref connected thereacross. The reference voltage is defined by a Zener diode 12 which is serially connected with the emitter-base path of a transistor 13. The transistor 13, which is of the pnp type, forms a control transistor. The cathode of the Zener diode 12 is connected to the diagonal connection 11. The base of the transistor 13 is connected to the diagonal terminal 11'. The collector of the control transistor 13 is connected to the base of a driver npn transistor 14, the emitter of which is connected to the chassis bus 5, and the collector through a collector resistor 15 to the positive bus 10.

The control signal source, formed for example by a magnetic, electro-optical or other ignition control system, provides control pulses i. The control pulses are applied via a coupling resistor 16 to the base of the driver transistor 14 as well as to the collector of the control transistor 13. The pulses i control the driver transistor 14 to be either in blocked condition, in which state current can flow from the positive bus 10 to the negative bus 5 through the switching transistor 4, or, suddenly, commanded to change to conductive condition in which the serially connected ignition transistor 4 will be command controlled, suddenly, to blocked condition, thereby interrupting current flow through the primary winding 2 of ignition coil 1, and including a high-energy pulse in the secondary 3, causing flash-over at spark plug 6.

In accordance with a preferred feature, the bridge circuit is adjustable, for example in dependence on an operating parameter of the ICE. Preferably, bridge resistor 7 is an adjustable resistor, the adjustment of the resistance value of bridge resistor 7 being so controlled that, upon increase of compression pressure D in the cylinder with which the spark plug 6 is coupled, the resistance of resistor 7 decreases.

Operation: If a pulse i is applied to the driver transistor 14, to block conduction through the driver transistor 14 and thus cause conduction of the switching ignition transistor 4, current in the primary winding 2 starts to rise. The rate of rise of this current should be controlled to be an optimum, that is, for optimum operation the rate of rise should be rapid enough to charge sufficient energy in the coil 1 between two sequential ignition events while leaving time to form an energy-rich spark while, on the other hand, not permitting current rise which is so rapid that a voltage will be induced in the secondary 3 of the coil 1 which results in an undesired spark at spark plug 6.

Optimum current rise through the primary 2—not too slow and not too fast but under optimum rate conditions—is obtained by controlling the control transistor 13 or, rather, its emitter-collector path, and—in dependence thereon—the emitter-collector path of the driver transistor, by the reference voltage Uref to such an extent that current will be branched from the base of the switching transistor 4 via the collector-emitter path of the driver transistor 14 to result in the optimum charge time constant. In other words, the control transistor 13 provides a current on its emitter-collector path which controls the base of the driver transistor 14 to permit some conduction of the driver transistor 14 and hence reduced conductivity of the switching transistor 4 during the current flow or "dwell" phase of an ignition event cycle to provide for charge current through the primary 2 of the coil 1 which rises at a rapid rate, but not rapidly enough to induce a secondary voltage in the secondary 3 to cause flash-over at spark plug 6. Good results are obtained if the voltage drop through the ohmic resistance of the primary 2 is at least substantially compensated for by branching current from the base of the switching transistor 4.

It is of advantage to permit adjustment of the bridge circuit in dependence on an operating parameter of the ICE. In the example shown, the resistance of the bridge resistor 7 decreases as the compression pressure within the cylinder increases. As the compression pressure in the cylinder increases, the secondary voltage which is necessary to cause flash-over at the spark plug also increases. Thus, the rate of rise in the primary winding 2 can increase more rapidly, as the compression pressure in the respective cylinder increases, than before.

In accordance with a modification of the invention, the bridge resistor 7 is selected to be somewhat higher than necessary to compensate for the ohmic voltage drop across the primary winding 2. Thus, the voltage over the secondary winding increases with increasing current, which, however, is permissible due to the increasing compression within the cylinder, which requires higher voltages to cause flash-over across the spark gap of the spark plug 6. The simplicity of the circuit, that is, not requiring an adjustment of the resistance 7, however, causes somewhat greater losses within the circuit.

In a typical circuit in which the voltage across buses 5, 10 is 12 volts, nominal, the following elements are suitable:

Zener diode 12: ZPD 3,9
transistor 13: BCY 79 IX
Uref: ~4.5 V
R7, resistance between 0.05 ohms and 1 ohms, maximum; or fixed: 0.5 ohms
resistor 8: 10kΩ
resistor 9: 1kΩ
ohmic resistance of primary winding 2: 0.25 Ω
transistor 4: RCA 16057
transistor 14: BSX 62-16
resistor 15: 33Ω
resistor 16: 1kΩ

I claim:

1. Ignition system for an internal combustion (ICE) having an ignition coil (1, 2, 3);

a spark plug (6) connected across the secondary (3) of the ignition coil;

a switching transistor (4) connected serially with the primary (2) of the ignition coil;

a control switching element (14) coupled to the switching transistor and controlling current flow therethrough, and comprising, in accordance with the invention, an ignition coil charging current control circuit to provided for controlled rapid rise of current through the ignition coil, yet inhibiting an excessive rate of current rise which might induce a premature spark in the spark plug (6), said ignition coil charging current control circuit including a bridge circuit (7, 8, 9, 2) of which the primary winding (2) of the ignition coil (1) forms one branch;

means (12, 13) for providing a reference voltage (Uref) coupled across a diagonal of the bridge circuit, said reference voltage providing means being coupled to the control switching element (14) which controls current flow through the switching transistor (4) to define an optimal charge rate of current flow through the ignition coil.

2. The system of claim 1, wherein said ignition coil charging control circuit includes a circuit connection branching control current from said control switching element to the base of the switching transistor (4) for at least approximately compensating for the voltage drop due to ohmic resistance of the primary winding (2) of the ignition coil (1).

3. The system of claim 1, wherein a branch (7) of the bridge circuit, other than the ignition coil (2), comprises a variable resistance element, the resistance of which is controlled in dependence on at least one operating parameter (D) of the internal combustion engine.

4. The system of claim 1, wherein the bridge circuit includes a resistor (7) serially connected with the primary winding (2) of the ignition coil and forming one branch thereof, said resistor having a value slightly in excess of the value necessary to compensate for voltage drop due to the ohmic resistance of the primary winding (2) of the ignition coil (3).

5. The system of claim 1, wherein the bridge circuit comprises a resistor (7) serially connected with the primary (2) of the ignition coil and defining a first diagonal junction (11), said resistor (7) and the primary (2) of the ignition coil forming one branch of the bridge;

two serially connected resistors (8, 9) defining a second diagonal junction (11) and forming a second branch of the bridge circuit, connected in parallel with said first branch;

wherein said means for providing a reference voltage comprises a Zener diode (12) and a control transistor (13), said transistor having its emitter-base circuit connected to the Zener diode, said Zener diode and emitter-base circuit being connected across the diagonal junctions (11, 11');

said control switching element (14) comprises a driver transistor (14) having its collector-emitter circuit connected across the base-emitter circuit of said switching transistor (4);

and wherein the collector of said control transistor (13) is connected to the base of the driver transistor (14);

and means (i, 16) are provided, controlling the driver transistor (14) to conduction or non-conduction to, in turn, control the switching transistor to non-conduction or conduction, respectively, in out-of-phase relationship with said driver transistor, current from the collector of the control transistor (13) modifying the conduction characteristics of the driver transistor (14) as controlled by said driver transistor conduction control means.

* * * * *